US006211448B1

(12) United States Patent
Shigenaga et al.

(10) Patent No.: US 6,211,448 B1
(45) Date of Patent: Apr. 3, 2001

(54) DRUM SET

(75) Inventors: Fumihiro Shigenaga; Takashi Hagiwara, both of Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 09/324,245

(22) Filed: Jun. 2, 1999

(30) Foreign Application Priority Data

Jun. 9, 1998 (JP) ..... 10-160652

(51) Int. Cl.[7] ..... G10D 13/02
(52) U.S. Cl. ..... 84/411 R; 84/420; 84/412
(58) Field of Search ..... 84/411 R, 420, 84/412, 419; D17/99, 22

(56) References Cited

U.S. PATENT DOCUMENTS 570,693 * 11/1896 Bemis ..... 84/411
2,850,156 * 9/1958 Shane ..... 206/47
3,215,021 * 11/1965 Kester, Jr. ..... 84/411
3,433,115 * 3/1969 Kjelstrom ..... 84/411
4,060,019 * 11/1977 Cordes ..... 84/411 R
4,191,085 * 3/1980 Litwin ..... 84/293
4,300,437 * 11/1981 Hinger et al. ..... 84/411 R
4,993,304 * 2/1991 Lovelet ..... 84/411 R
5,419,430 * 5/1995 Wilson et al. ..... 206/216

FOREIGN PATENT DOCUMENTS

604891 * 3/1960 (IT) ..... 84/411

* cited by examiner

*Primary Examiner*—Robert E. Nappi
*Assistant Examiner*—Kim Lockett
(74) *Attorney, Agent, or Firm*—Koda & Androlia

(57) ABSTRACT

The bass drum of a drum set provided with drum heads at both ends of the cylindrical shell comprising first and second shell segments which can be split in the axial direction and detachably coupled so that the interior of the bass drum can hold, for instance, drum attachment fixtures, tom-toms, snare drums and so on. The bass drum is provided with auxiliary legs, a handle, a height adjuster leg, and the like attached on the outer surface of the shell.

4 Claims, 4 Drawing Sheets

DRUM SET

BACKGROUND OF THE INVENTION

1. Field of the Invention

The present invention relates to a drum set comprising a plurality of drums including a bass drum.

2. Prior Art

A drum set used in, for instance, jazz and rock band performances generally includes a 20-inch (or 22- or 18-inch) bass drum, a plurality of tom-toms set over the bass drum, a floor tom set on the left of the bass drum, high-hat cymbals set on the right, and a snare drum.

A problem with these conventional drum sets, however, is that each drum needs to be carried individually when the drum set is moved, and this makes the transportation of the drum set difficult. Another problem is that the drum set takes up quite a large floor space when the drums are stored next to each other. If they are stacked on top of each other, the stack becomes so high and unstable that there is a danger that the stack of the drums may topple.

One known means to solve this problem is a drum set in which a drum head is fixed over the opening on one side of the shell of the bass drum, and the opening on the other side is left open, so that the other smaller drums such as the tom-toms can be put in the shell of the bass drum through the opening. However, such a single-head bass drum has a performance range narrower than a double-headed bass drum; accordingly, the problem with this approach is that the drum set with such a buss drum cannot be used in performances with ordinary band compositions.

Japanese Patent Application Laid-Open (Kokai) No. S57-185487 discloses a practice drum set in which the other smaller drums are stored inside the bass drum. The problem here, however, is that this drum set is intended only for practice by beginners and cannot be used for ordinary performances because a sound-deadening pad is put on the back of the drum head.

SUMMARY OF THE INVENTION

Accordingly, the present invention is to solve the problems encountered in the past, and the object of the present invention is to provide a drum set that can be used in ordinary performances and is also easy to transport and stows away in a compact fashion.

The above object is accomplished by a unique structure for a drum set comprising a bass drum and a plurality of other drums that fit within the shell of the bass drum, wherein the shell of the bass drum is made up of first and second shell segments separated in the axial direction of the shell and detachably coupled to each other, and a drum head is provided on the open end of each one of the shell segments so as to be on the opposite side from the open end of the coupling side. In this structure, each one of the shells may have air holes.

With the structure above, in the present invention, the bass drum, when assembled, can be used for ordinary performances because drum heads are installed at both ends; and when the two shell segments are separated, the other drums are stowed inside. The air holes improve sound escape and facilitate the vibration of the drum heads.

DETAILED DESCRIPTION OF THE PREFERRED EMBODIMENTS

Figure 3:
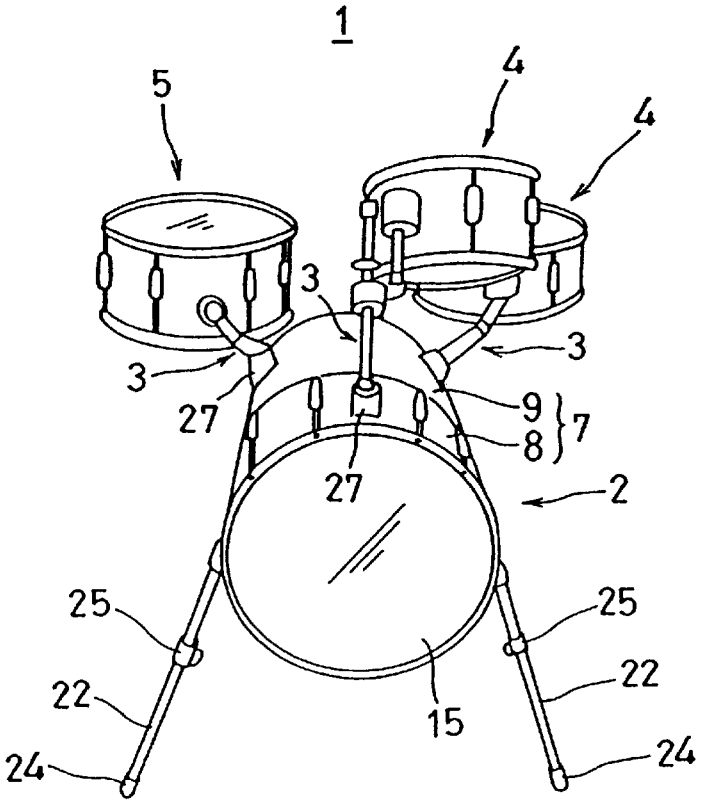
FIG. 3 is a perspective the drum set which is set up for a performance.
Figure 4:
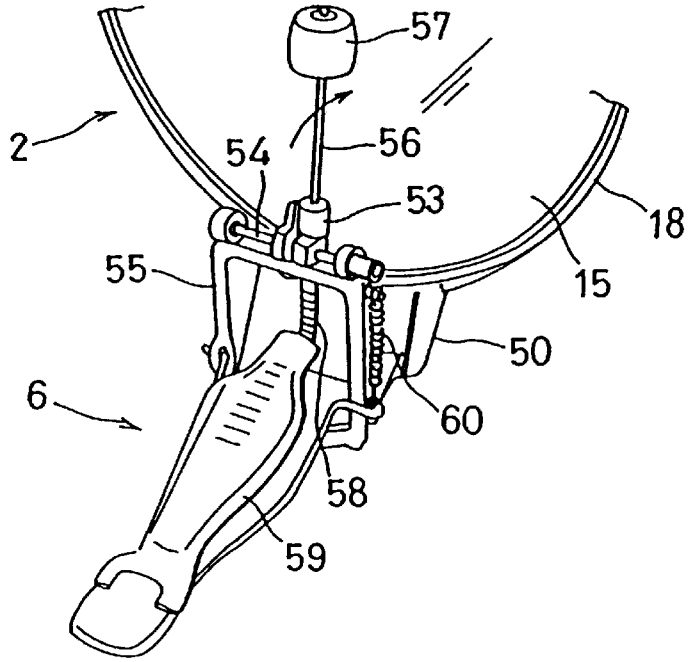
FIG. 4 is a perspective view showing a foot pedal attached to the shell of the bass drum.

As seen from the accompanying Figures, particularly from FIGS. 3 and 4, the drum set 1 according to the typical embodiment of the present invention comprises a bass drum 2, two tom-toms 4 of different sizes and a snare drum 5 which are mounted to the bass drum 2 via drum attachment fixtures 3, in addition to a foot pedal 6.

The bass drum 2 comprises a shell 7 formed in a cylindrical shape from wood, fiber-reinforced plastic (FRP), metal, or the like. The shell 7 consists of first and second shell segments 8 and 9 that are split in the axial direction of the bass drum 2 and detachably coupled to each other. The internal space of the shell 7 forms a storage compartment 10 for stowing the drum attachment fixture 3, tom-toms 4 and snare drum 5. In other words, the shell 7 is long enough in the axial direction so as to accommodate the tom-toms 4 and snare drum 5 in a stacked fashion. The bass drum 2 is one with a diameter of 14 to 20 inches.

Figure 1:
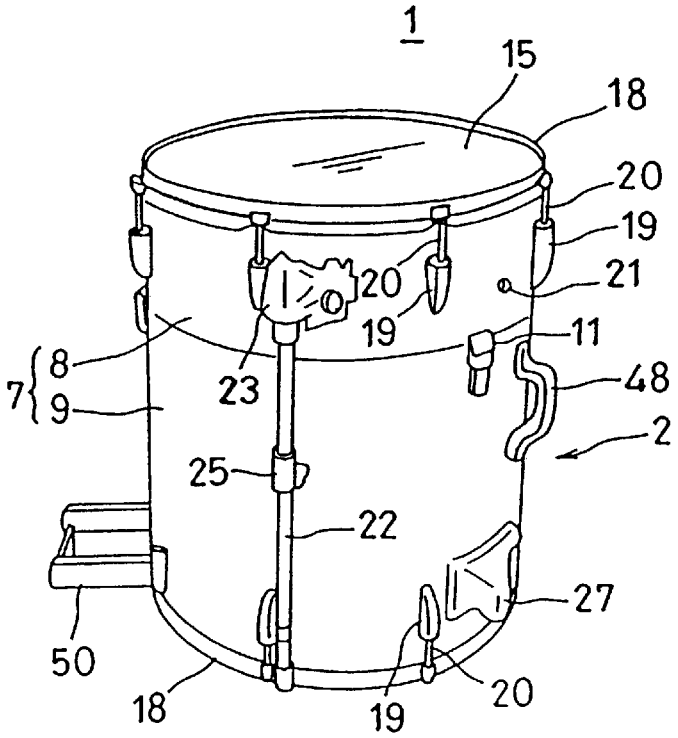
FIG. 1 is a perspective view of the drum set according to the present invention in its storage state.
Figure 5:
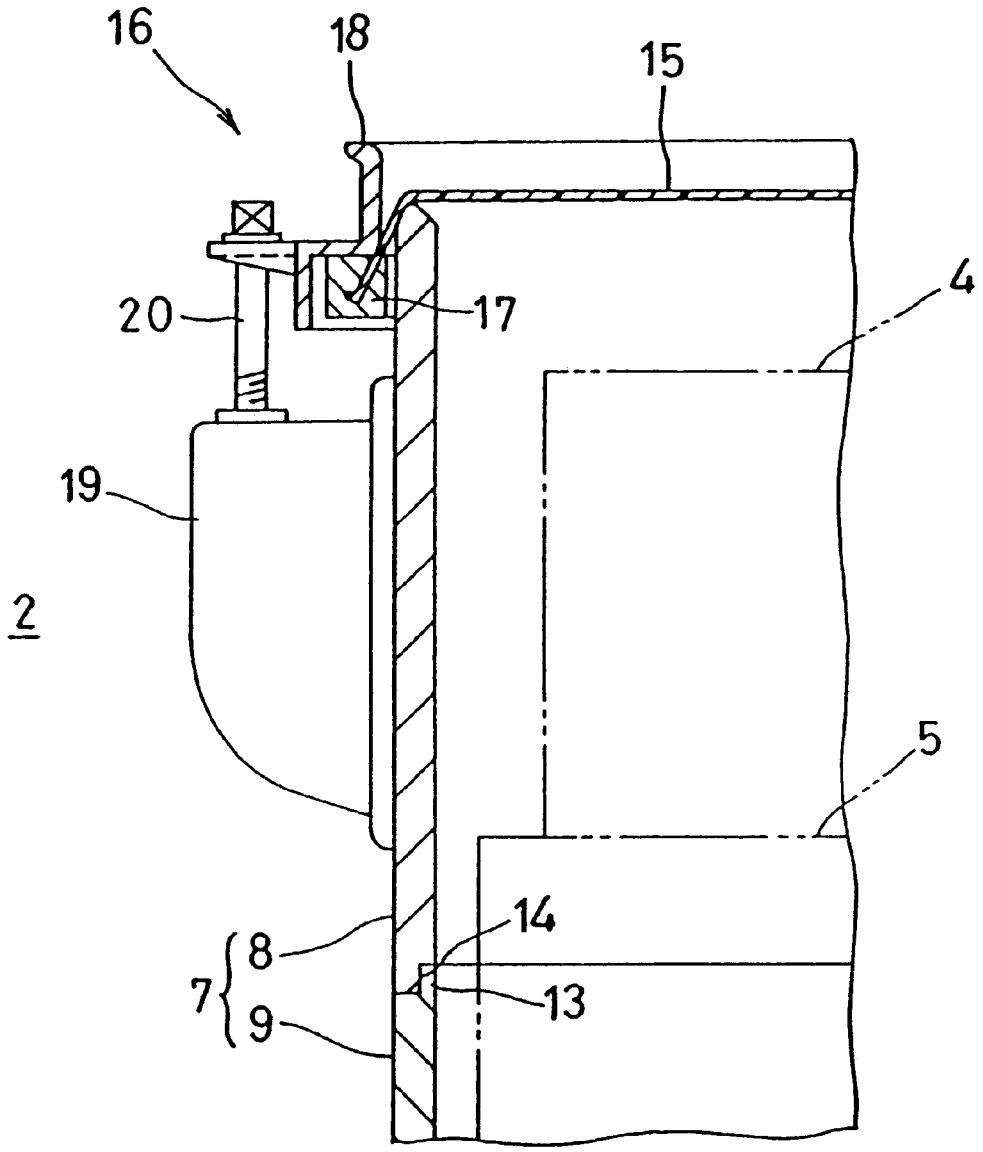
FIG. 5 is a cross section of the main part of the bass drum.

The first and second shell segments 8 and 9 have the same inside and outside diameters. They are fitted together at one end by an in-low structure and are separably coupled to each other by a plurality of clamp assemblies 11 attached on the outer surfaces. The open ends on the coupled side of the first and second shell segments 8 and 9 may have a variety of shapes; and a projection 13 and depression 14 combination as shown in FIG. 5 is preferable so as to fit the segments together because with the projections 13 and depressions 14 the segments can be coupled without any rubbing. A drum head 15 is installed on the open end of each of the first and second shell segments 8 and 9 on the side opposite from the open ends where they are coupled together. The drum heads 15 are formed from a natural leather, synthetic resin film (such as a polyester resin or polycarbonate resin) or the like, and they are each supported and stretched at an even tension by a plurality of head support and stretching means 16 attached on the outer surface of the shell segments 8 and 9. In the shown embodiment, the first and second shell segments 8 and 9 have different lengths (or depth in the axial direction). In other words, as seen from FIG. 1, the second shell segment 9 is longer (deeper) than the first shell segment 8. Thus, the second segment 9 is used as a container for stowing the tom-toms 4, snare drum 5, and so on, and the first shell segment 8 is used as a lid.

As best seen from FIG. 5, the head support and stretching means 16 each comprises: an annular head frame 17 that supports the peripheral edge of the drum head 15 and is fitted to the outer surface of the open end of the shell 7 (or of the first segment 8 in FIG. 5), an annular fastening frame (hereinafter referred to as a rim) 18 that is also fitted on the outer surface of the shell 7 so as to press on the head frame 17, tightening bolts 20 that link the rim 18 to the shell 7 via lugs 19, and other parts. The pressure that the rim 18 exerts on the head frame 17 is changed by turning the tightening bolt(s) 20 with a tuning key (not shown) so as to shift the rim 18 in the axial direction. The tension of the drum heads 15, that is to say the timbre of the drum, can thus easily be changed. In addition, since the drum heads 15 can thus be tuned, the drum of the present invention can be played as an ordinary acoustic drum. The lugs 19 are attached to both the first and second shell segments 8 and 9.

In addition, a plurality of air holes 21 are formed in the first shell segment 8. These air holes 21 are or improving sound escape by allowing communication between the inside and outside of the shell 7, and also facilitate the vibration of the drum heads 15 and make the drum easier to play.

Figure 2:
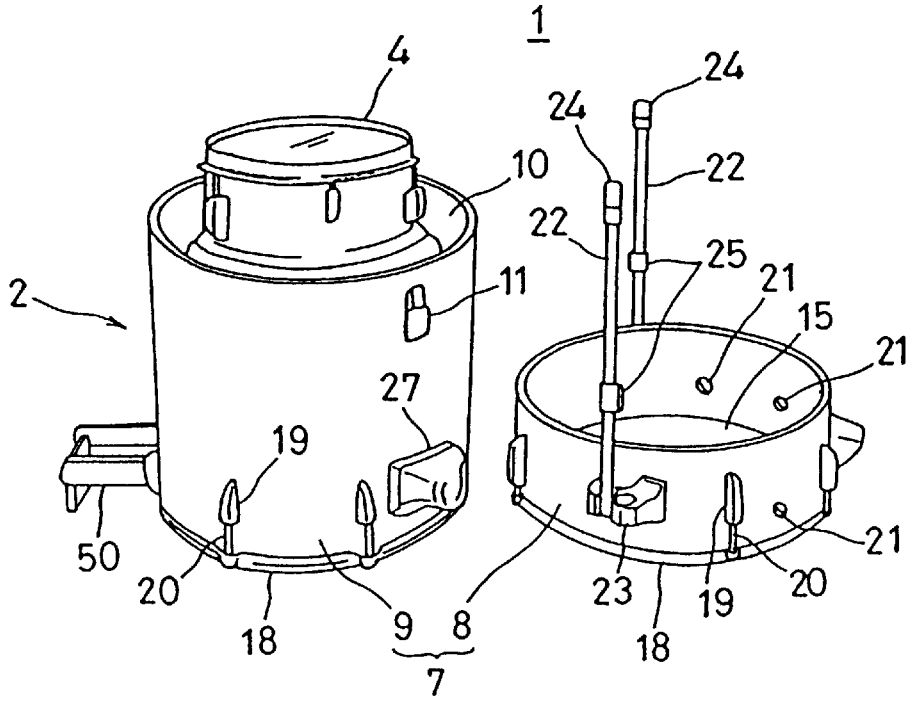
FIG. 2 is a perspective view showing the two shell segments separated.

Furthermore, two auxiliary legs 22 that stably support the shell 7 so as not to fall over are attached to portions on either side when the shell 7 is set up on the floor facing sideways. As best seen from FIGS. 1 and 2, the root portions of the auxiliary legs 22 are attached to leg support fixtures 23 fixed to the outer surface of the first shell segment 8 so as to be pivotal in the radial and axial directions of the shell 7, and the auxiliary legs 22 are provided with rubber feet 24 at their distal ends. When not in use, these auxiliary legs 22 are brought to near the outer surface of the shell 7 and latched to the outer surface of the second shell segment 9 by latches 25.

Figure 6:
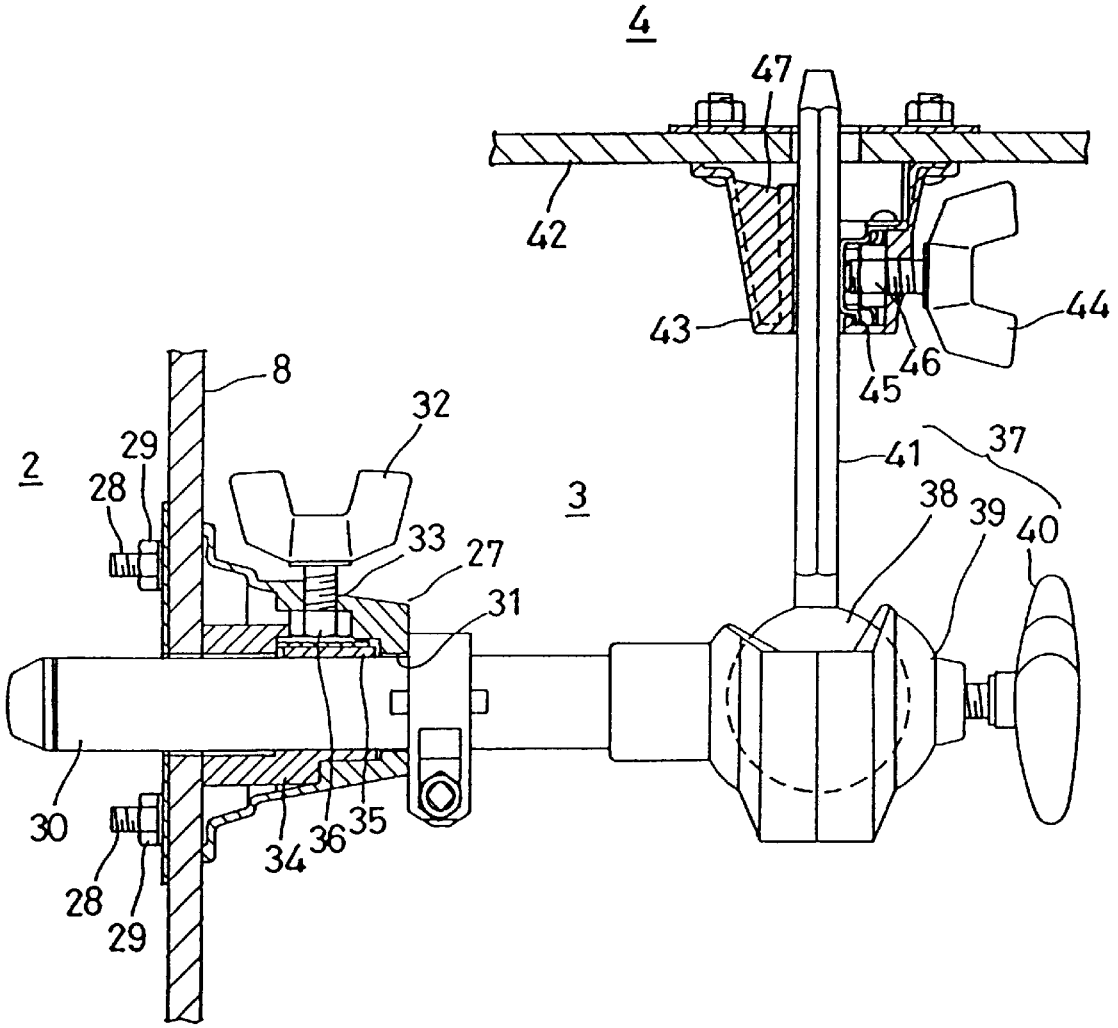
FIG. 6 is a cross section of the drum attachment fixture.

Furthermore, as seen from FIG. 6, attachment members 27 for attaching the drum attachment fixtures 3 are fixed by a plurality of bolts 28 and nuts 29 (only one shown in FIG. 6) to the outer surfaces of the first and second shell segments 8 and 9. The attachment members 27 are located at the portions that are on top when the shell 7 is placed on the floor facing sideways. Each of the attachment members 27 is formed in the shape of a truncated cone from an aluminum alloy or the like, and it has an insertion hole 31 and a screw hole 33. The insertion hole 31 is formed in the center of the distal end surface of the attachment member 27 so that the rod 30 of the drum attachment fixture 3 is inserted, and the screw hole 33 is formed in the peripheral wall of the attachment member 27 so that a wing bolt 32 for fixing the rod 30 to the attachment member 27 is inserted. Housed inside the attachment member 27 are a cylinder 34 through which the rod 30 is passed, a pressing plate 35 pressed against the outer periphery of the rod 30 by the wing bolt 32, and a nut 36 that screw-engages the wing bolt 32.

Each of the drum attachment fixtures 3 includes, in addition to the rod 30, a ball joint 37 attached to the end of the rod 30 on the opposite side from the bass drum 2. The ball joint 37 comprises a ball 38, an enclosing member 39 having a spherical ball holder and enclosing the ball 38 so that the ball 38 can rotate by a specific angle in all directions, and a bolt 40 or the like that presses the ball 38 against the inner surface of the enclosing member 39. A linking bar 41 is integrally projected from the ball 38 so as to be perpendicular to the rod 30. This linking bar 41 supports a tom-tom 4 (or the snare drum 5) by being inserted into an attachment member 43 attached to the outer surface of the shell 42 of the tom-tom 4 (or the snare 5) and being fixed by a wing bolt 44. Installed inside the attachment member 43 are a pressing plate 45 pressed against the linking bar 41 by the wing bolt 44, and a nut 46 that screw-engages the wing bolt 44. Furthermore, a projection 47 corresponding to the pressing plate 45 is integrally projected in the centerline direction from the inner peripheral surface of the attachment member 43. Thus, the linking bar 41 is held between this projection 47 and the pressing plate 45.

Furthermore, the outer surface of the second shell segment 9 is provided with a carrying handle 48, and it is also provided with a height adjuster leg 50 to which the foot pedal 6 is attached. The handle 48 is gripped when the drummer or someone else transports the bass drum 2. The height adjuster leg 50 is provided near the drum head of the second shell segment 9; and together with the auxiliary legs 22, the leg 50 keeps the drum head 15 elevated off the floor, which allows the struck portion of the drum head 15 (usually the approximate center) to be roughly aligned with the beater height of the foot pedal 6.

As seen from FIG. 4, the foot pedal 6 comprises a rotating shaft 54 that has a rocker 53, a supporting frame 55 that rotatably supports this rotating shaft 54, a beater 57 attached to the rocker 53 via a beater rod 56, a foot board 59 coupled to the rocker 53 via a timing belt 58, a compression coil spring 60 that imparts a rotational tendency in the return direction to the rotating shaft 54, and so on. The foot pedal 6 thus constructed is known in the past; and with the supporting frame 55 detachably attached to the height adjuster leg 50, when the foot board 59 is depressed and the rotating shaft 54 is rotated against the compression coil spring 60, the beater 57 pivots integrally with this action and strikes the drum head 15, and when the pressure is removed from the foot board 59, the force of the compression coil spring 60 causes the foot board 59 to rise and return to its original position.

In the drum set 1 of the present invention as described above, the shell 7 of the bass drum 2 consists of first and second shell segments 8 and 9 which are formed so that they are split in the axial direction, and the tom-toms 4, snare drum 5, and other components are stowed in a stacked fashion in the interior thereof. Thus, it is easy to carry the drum set. In particular, with the handle 48, there will be no need for a casing for the drum set, thus making the drum set even easier to carry and enhancing transportability. In addition, since only enough room to store the bass drum 2 is needed to store the entire drum set, the drum set takes up less storage space; and since the tom-toms 4, the snare drum 5 and other components are kept inside the bass drum 2, there is no danger of losing them.

Moreover, since the bass drum 2 of the present invention is a double-head drum just as an ordinary acoustic drum, it can be used with no inconvenience whatsoever in band performances; and furthermore, it can be used as a single-head drum as well if the first and second shell segments 8 and 9 are separated.

When a cushioning material is interposed between the first and second shell segments 8 and 9, the impact can be softened and damage to the shell segments can be prevented. Also, by designing the bass drum 2 big enough, accessories for the set can also be stored therein.

As described above, according to the present invention, the drum set can be used for ordinary performances; and it is easy to transport and stows away in a compact fashion.

What is claimed is:

1. A drum set comprising a bass drum and a plurality of other drums that can fit inside a cylindrical shell of said bass drum, wherein said shell is provided with a drum head on each one of both axial ends thereof and is comprised of first and second shell segments which can be split in an axial direction of said shell and coupled to each other and one of said first and second shell segments is provided with a projection on an open end which is opposite from an end on which said drum head is provided and another of said first and second shell segments is provided with a depression on an open end which is opposite from an end on which said drum head is provided so that said projection and depression engage each other, thus coupling said first and second shell segments together.

2. The drum set according to claim 1, further comprising an air hole provided in said shell of said bass drum.

3. The drum set according to claim 1, wherein one of said first and second segments is axially longer than another of said first and second segments.

4. The drum set according to claim 1, further comprising a plurality of clamp assemblies which detachably couple said first and second segments to each other.

* * * * *